United States Patent [19]

Annas, Sr. et al.

[11] Patent Number: 4,792,121

[45] Date of Patent: Dec. 20, 1988

[54] LIFTER

[75] Inventors: Dulin L. Annas, Sr., Hickory; Richard M. Teague, Taylorsville, both of N.C.

[73] Assignee: Anteg, Inc., Hickory, N.C.

[21] Appl. No.: 131,459

[22] Filed: Dec. 11, 1987

[51] Int. Cl.[4] ..... B66F 7/12

[52] U.S. Cl. ..... 254/95; 254/11; 254/97

[58] Field of Search ..... 254/11, 12, 95, 97, 254/103

*Primary Examiner*—William L. Sikes
*Assistant Examiner*—Akm Ullah
*Attorney, Agent, or Firm*—Roy B. Moffitt

[57] ABSTRACT

A device for lifting and positioning a heavy object, comprising a base, a pair of arcuate arm moving rack gears, a pair of arms rotatively affixed to the arcuate rack gears, a pair of arm moving pinion gears fixed to an axle rotatively affixed to each arm and in mechanical engagement with one of the pair of arcuate arm moving rack gears adapted when rotated to move the pair of arms up and down, a foot device rotatively affixed to the pair of arms, a foot pinion gear fixed to an axle rotatively fixed to the pair of arms and fixedly attached to the foot to rotate the foot when the foot pinion gear is rotated, a foot control pinion gear fixedly attached to the base, an elongated member having a rack gear on both of its terminal portions, one of such rack gears in mechanical engagement with the foot pinion gear and the other elongated member rack gear in mechanical engagement with the foot control pinion gear so that when the arm moving pinion gears rotate they cause not only the arm to move up and down but also cause the rack gear of the elongated member in engagement with the foot to linearly move the elongated member rack gear in engagement with the foot control pinion gear and to thus rotate the foot pinion gear to maintain the foot stable and essentially horizontal as the pair of arms are moved from the horizontal to the vertical position and points in between.

11 Claims, 8 Drawing Sheets

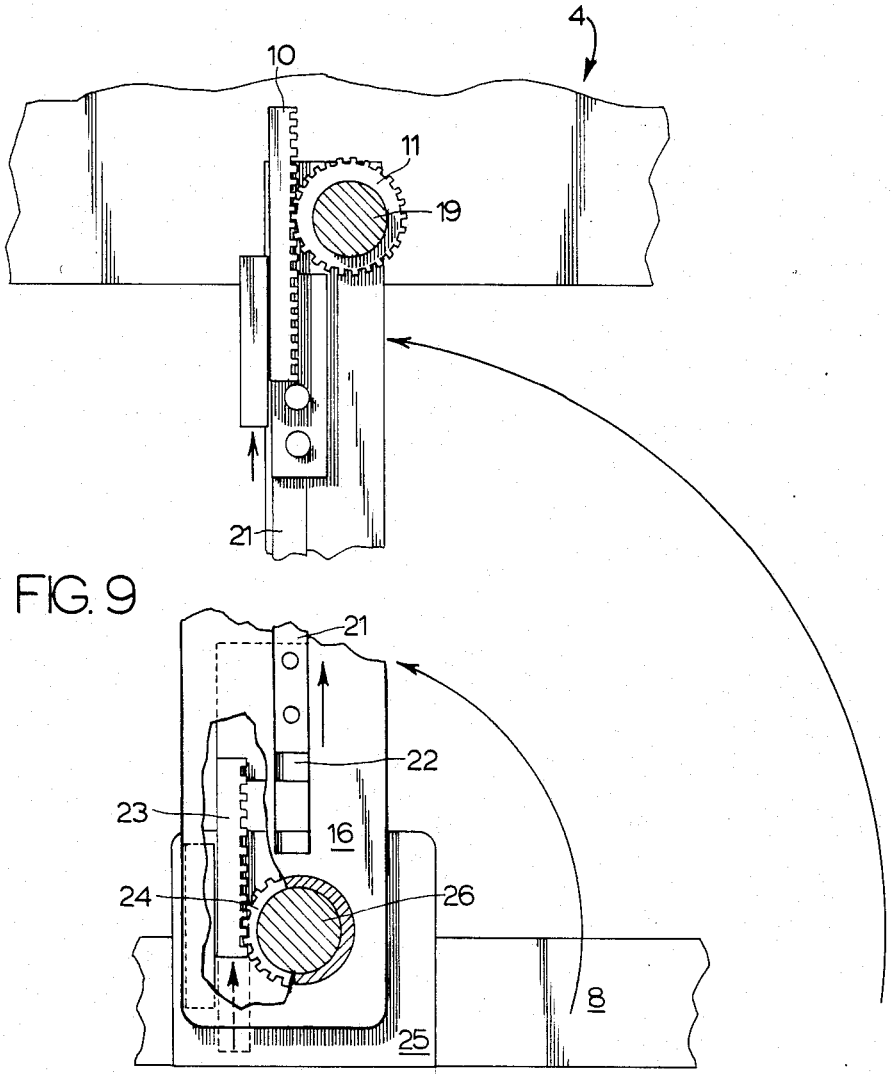
FIG. 9
FIG. 10
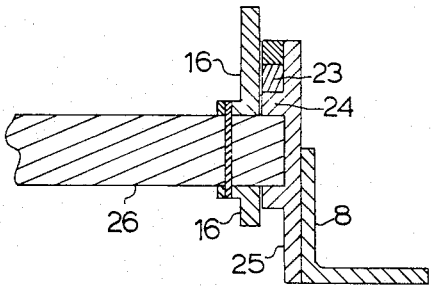

LIFTER

FIELD OF THE INVENTION

The invention relates to lifting devices used to lift heavy objects.

BACKGROUND OF THE INVENTION

In the furniture industry, upholstered furniture is built by a series of craftsmen in a series of steps, each craftsman having a specialty in the manufacturing process. At each step, the work in process is lifted and positioned on a support, usually two "saw horses", and the craftsman then performs his speciality with the workpiece in that position. The fruit of his labors is then removed from the support and then moved to another station where still another craftsman lifts the work in process onto another support and performs his particular task. This basic process is continued until the work in process becomes finished goods.

This basic method is shown in FIG. 1 and 2, the figures showing the initial station in an upholstering furniture production process, namely, the providing of a wooden frame 2 and placing it on saw horses 1 by craftsman 3 in preparation to performing various upholstering procedures to frame 2.

Apart from the inconvenience of lifting required by craftsman 3 and associated Workman's Compensation Claims associated with lifting, the prior art method limits the workpiece (frame 2) to one elevated position, i.e., that position shown in FIG. 2. It would be more desirable if the craftsman had the capability of not only avoiding the physical danger of lifting workpiece 2, but could place it in a multitude of positions compatible to the craftsman's height or body build, and/or the particular task at hand. It is towards the solution of these problems that this invention is directed.

BRIEF DESCRIPTION OF THE INVENTION

The device for lifting and positioning a heavy object, as hereinafter more fully described, includes a pair of arms rotatively affixed to a pair of arcuate rack gears fixed to a base; a pair of arm moving pinion gears, each such arm moving pinion gear pair member is fixed to an axle rotatively fixed to each arm and is in mechanical engagement with one of the pair of arcuate rack gears so that when the arm moving pair of pinion gears are rotated they move the pair of arms in a predetermined direction; a foot device rotatively affixed to the pair of arms; a foot pinion gear fixed to an axle rotatively affixed to the pair of arms and fixedly attached to the foot to rotate the foot when the foot pinion gear is rotated; a foot control pinion gear fixedly attached to the base; and, an elongated member having a rack gear on each of its terminal portions, one of such rack gears being in mechanical engagement with the foot pinion gear and the other elongated member rack gear being in mechanical engagement with the foot control pinion gears. In such a combination, when the arm moving pinion gears rotate they cause the elongated member to rotate around the fixed (stationary) foot control pinion gear, which in turn causes the rack gear on the opposite end of the elongated member to move forwardly in a linear fashion and rotate the foot pinion gear at the foot. It is this rotation and mechanical engagement of the elongated member rack gears with the foot and foot control pinion gears that maintains the foot stable and essentially horizontal as the pair of arms of the lifting device are moved from the horizontal to the vertical position (or vice versa) and points inbetween.

BRIEF DESCRIPTION OF THE DRAWINGS

FIGS. 7, 8, and 9 are fragmented side elevation views of the foot, foot control pinion and a rack gear connecting the two to form a mechanism to control the level and stabilize the position of foot 4 no matter the position of the lifter's arm in the horizontal, 45 degrees horizontal and vertical positions respectively.

FIG. 10 is a cross-sectional view of a foot control rack and pinion gear support apparatus of FIGS. 7, 8 and 9 along line 7—7.

DETAILED DESCRIPTION OF THE INVENTION

Figure 1:
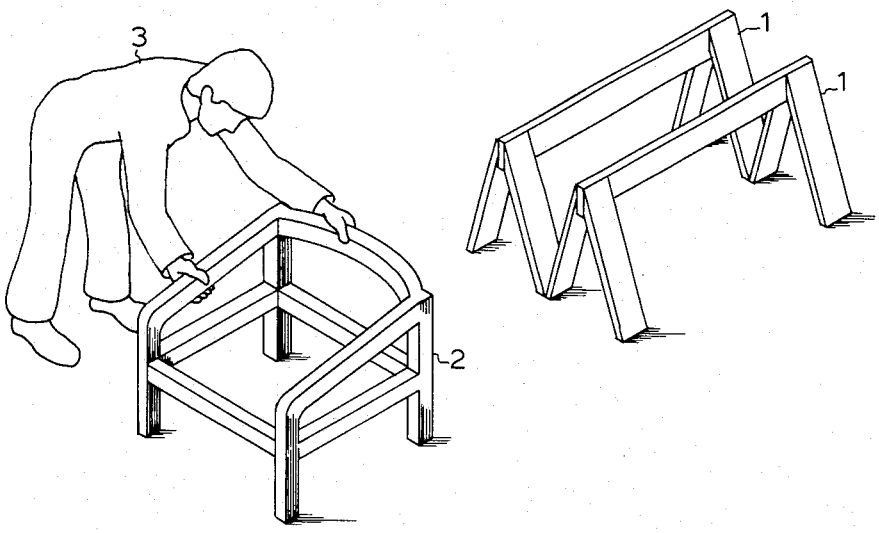
FIGS. 1 and 2 are perspective views of prior art practice involving a working support created by two "sawhorses? upon which a workman places a wooden furniture frame to carry out various manufacturing processes.
Figure 2:
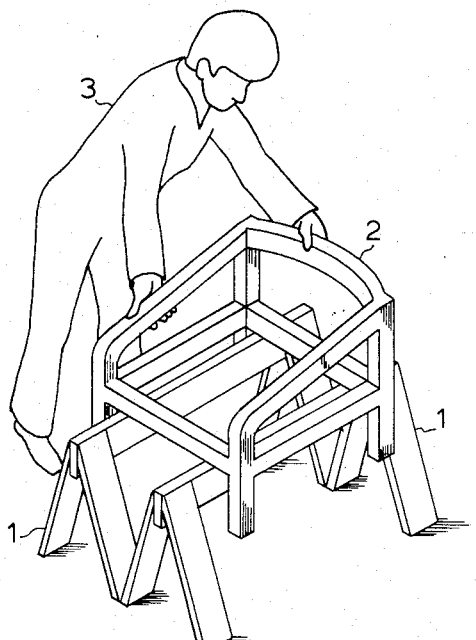

The procedure and apparatus for making upholstered furniture shown in FIGS. 1 and 2 represent prior art. Sawhorses 1 are placed together to form a working support upon which wooden furniture frame 2 is ultimately placed. Furniture frame 2 is then grasped, lifted and placed upon sawhorses 1 by workmen 3 as shown. In this position, the speciality of wokkman 3 is then performed on frame 2. The work in process is then removed from sawhorses 1 and passed to another workman. Additional tasks are performed on element 2 employing such procedure until a piece of upholstered furniture is completed. Represented by furniture frame 2, the work in process goes through a multiplicity of manufacturing steps and stages and each time it is lifted from floor surface to a pair of sawhorses and then removed, placed again on a floor surface and transported to another location where the same lifting and placement takes place and additional upholstering steps are taken.

Figure 3:
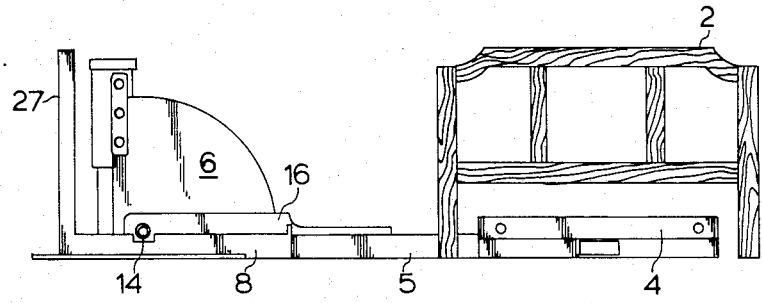
FIGS. 3, 4, and 5 are side elevations of the invention used in its intended environment, FIGS. 4 and 5 showing the invention positioning the furniture frame in two different positions.
Figure 4:
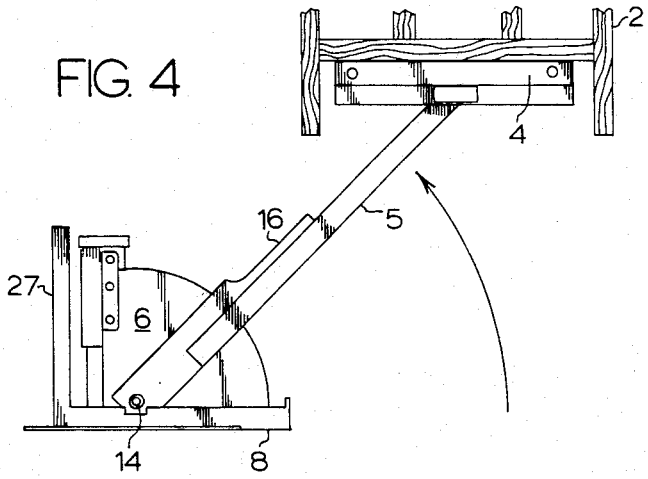
Figure 5:
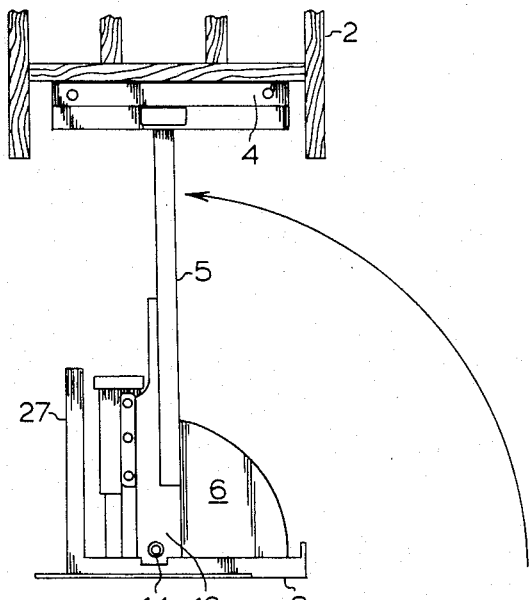
Figure 6:
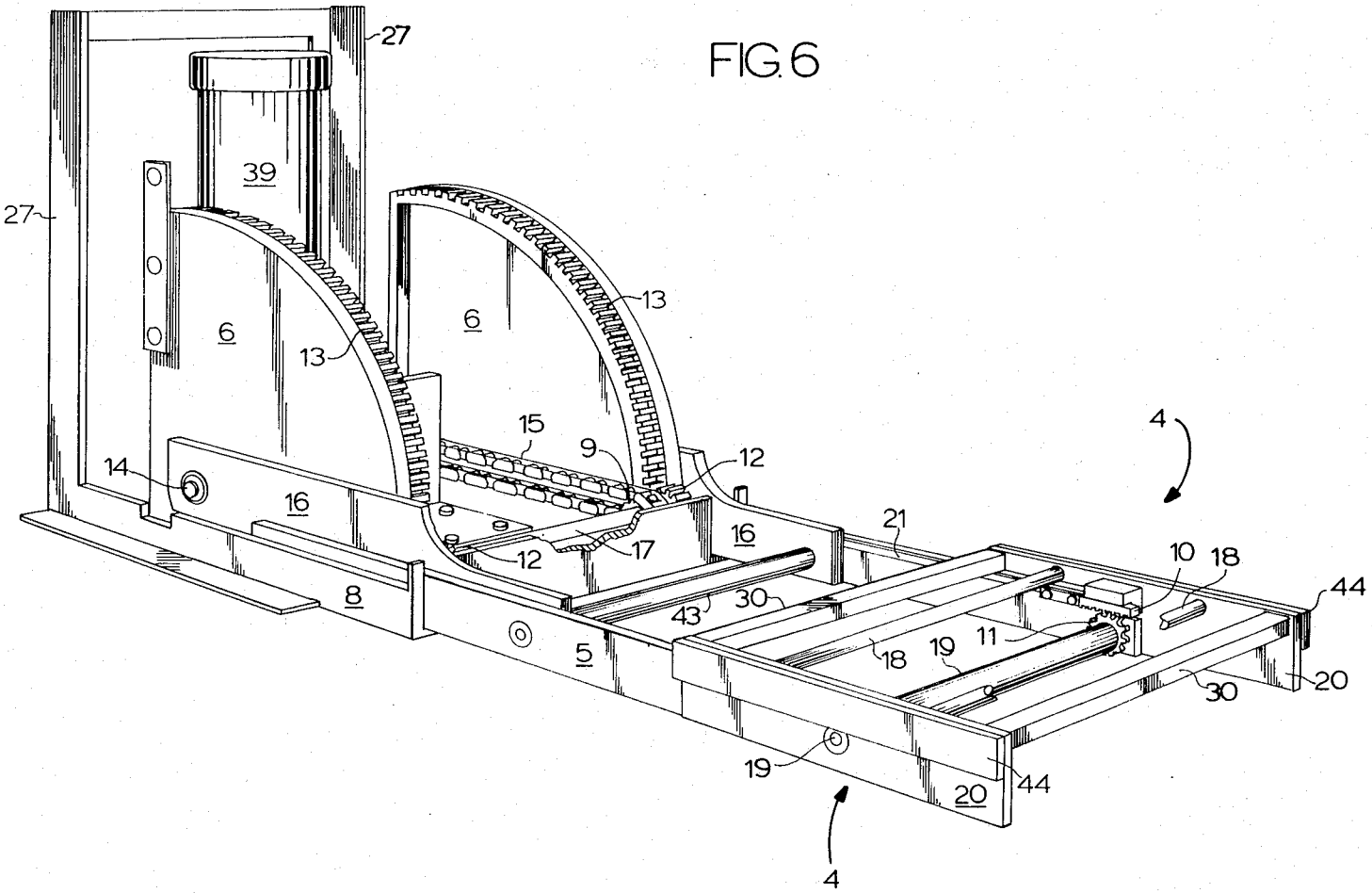
FIG. 6 is a perspective view of the invention.
Figure 7:
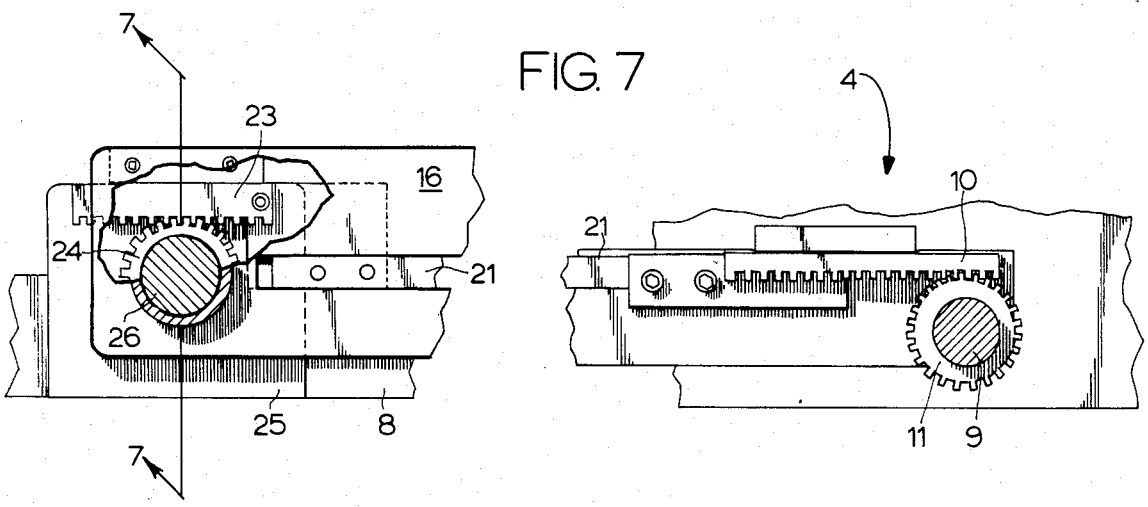
Figure 8:
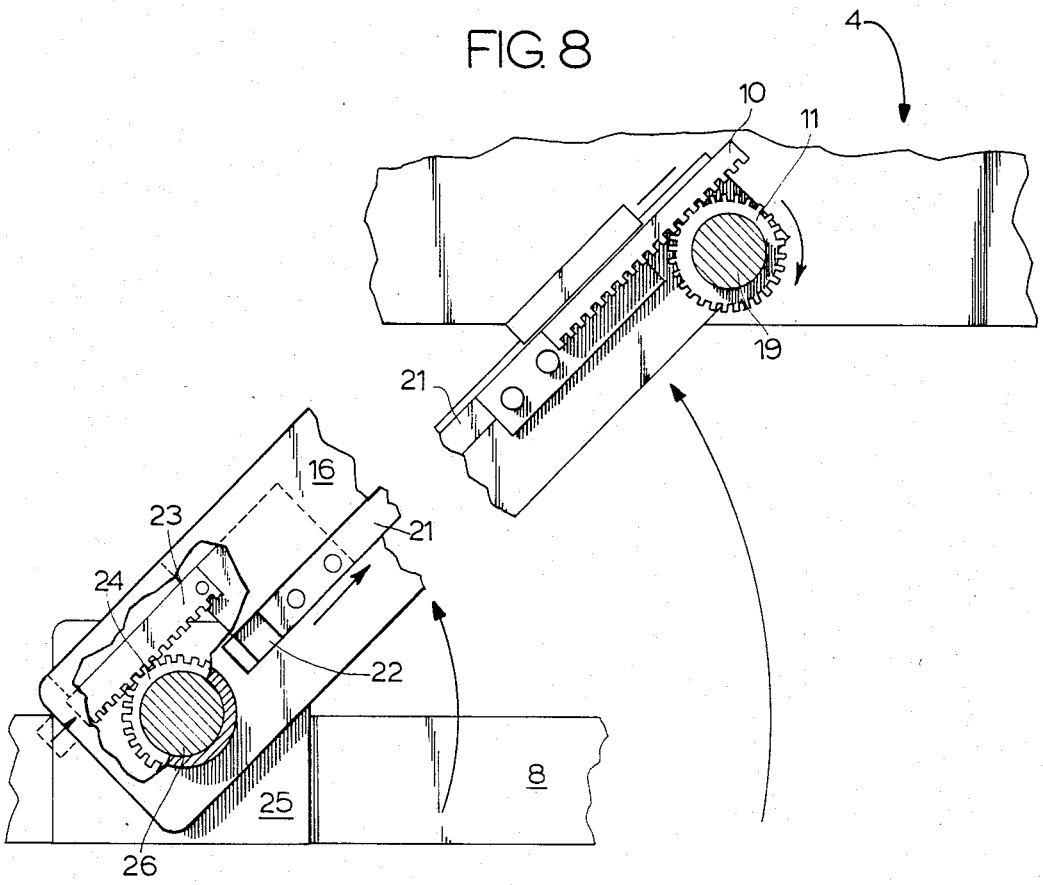

Referring now to FIGS. 3, 4, 5, and 6, there is shown in FIGS. 3, 4, and 5 side elevation of the invention used in its intended environment. In its broadest sense, the invention is composed of a frame comprising upstanding and lateral portions 27 and 8 respectively, and a pair of arcuate arm moving rack gears 6. Rack gears 6 are spaced apart and are disposed between upstanding portions 27 and lateral portions 8 as shown. Attached to each rack gear 6 is a first terminal portion 16 of an arm. Represented by element 5 is a second terminal portion of the arm. Element 16 is rotatively fixed to rack gear 6 by axles 14 and 26. See FIGS. 6, 7, and 8. Each arm first terminal portion 16 is fixed to arm second terminal portion 5 by means of cross member 43. As is shown in FIG. 6, the two upstanding arcuate rack members 6 have teeth 13 disposed on the surface of each of the pair members, which are in mechanical engagement with arm moving pinion gear pair 12.

Figure 11:
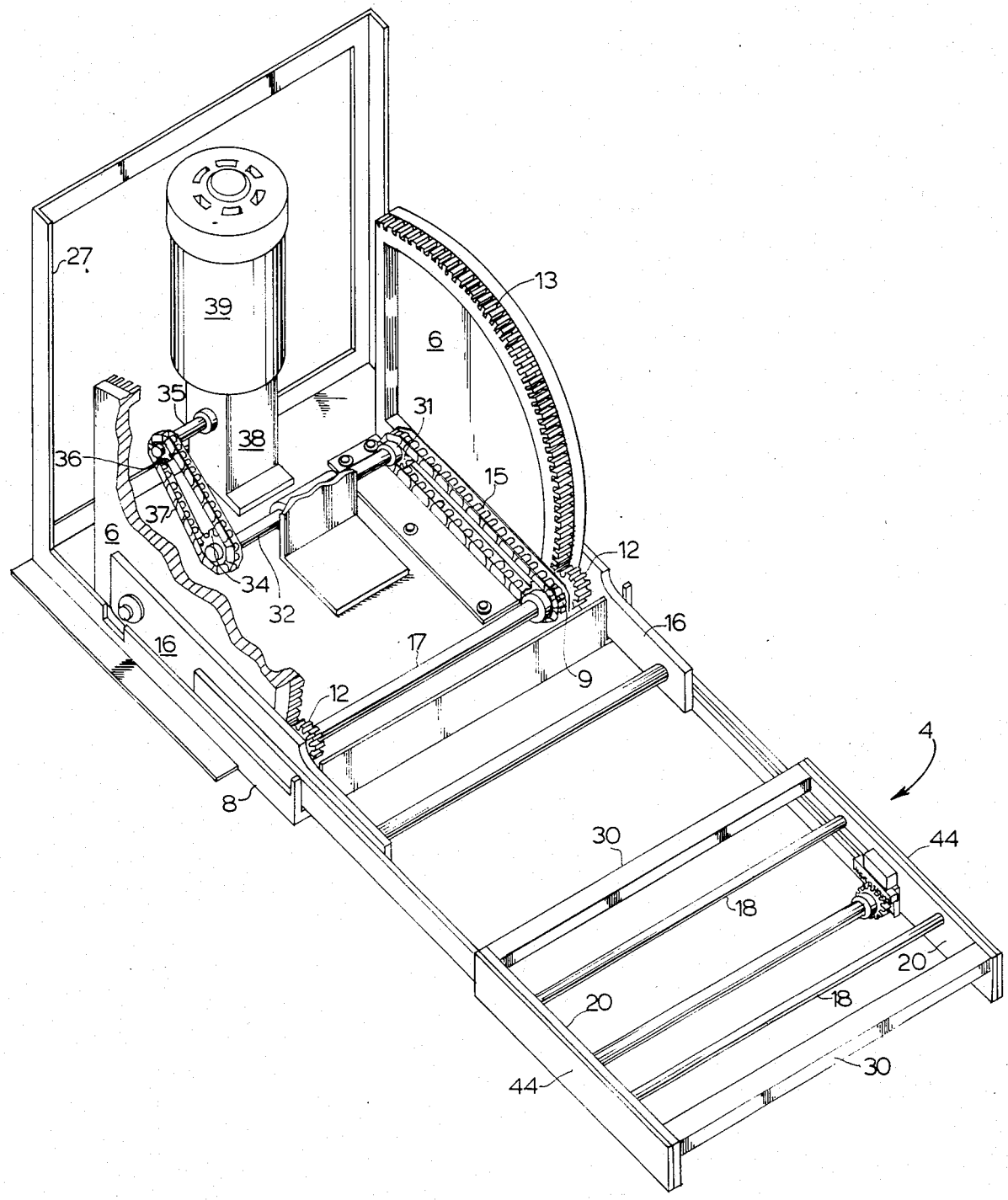
FIG. 11 is a perspective cut-a-way view of the invention.
Figure 12:
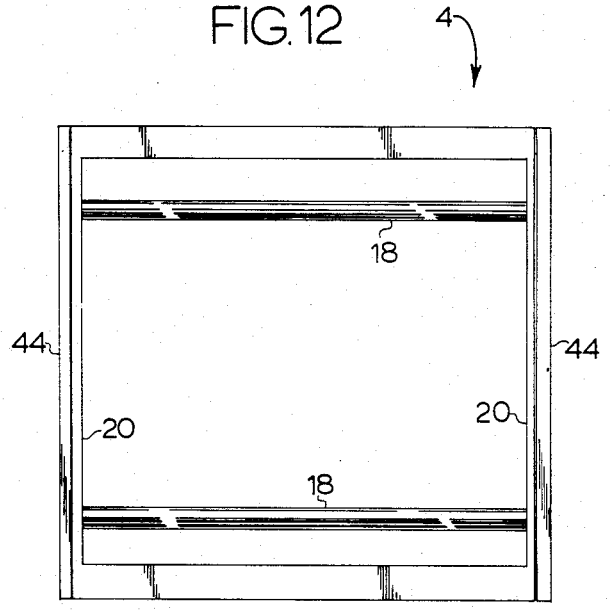
FIG. 12 is a plan view of the moveable foot of the invention.
Figure 13:
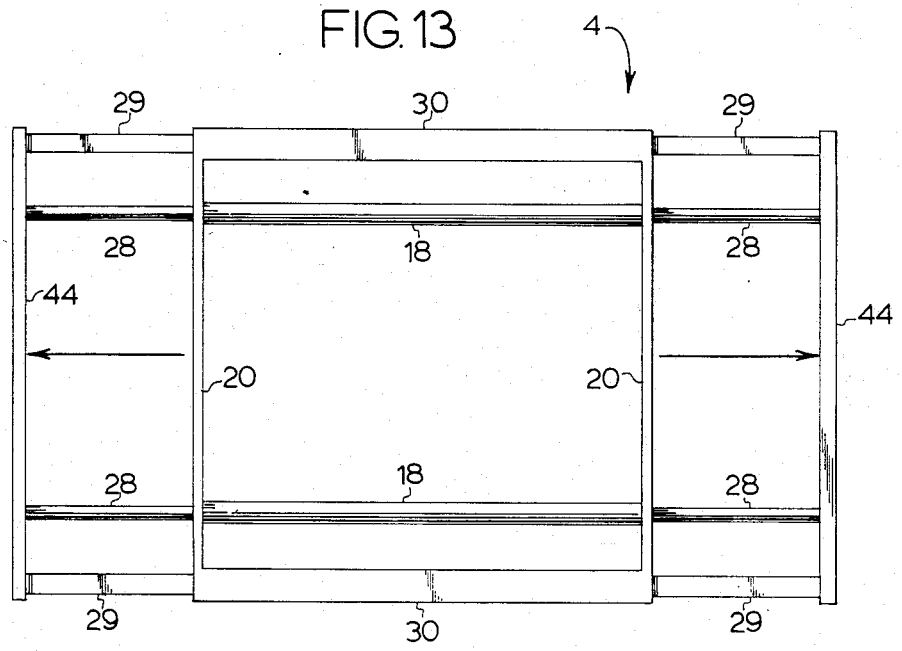
FIG. 13 is a plan view of the moveable foot of FIG. 12 depicting expansible portions.

Foot 4 which provides the surface upon which workpiece 2 is positioned, is made up of spaced apart side members 20 fixed to each other by spaced apart cross members 18 and 30. Members 44 can be extended laterally as shown in FIG. 13. Extension members 28 and 29 are slideably received in cross members 18 and 30. Side members 44 are affixed to extension members 28 and 29 forming a "T? shaped configuration. Element 28 is slideably received in cross member 18 and element 29 is slideably received in element 30 of foot 4. Not shown in FIGS. 11 and 12, but shown in FIG. 6 is rotatable axle 19 to which side members 20 of foot 4 are fixed. Also fixed to axle 19 is foot pinion gear 11, paired with a corresponding foot control pinion gear 24, see FIGS. 7 and 8.

One of arm members 5 has a slot 22 (FIG. 8) in its inwardly facing surface and in such slot there is slideably disposed an elongated member 21. On the terminal positions of elongated member 21 are rack gears identified by elements 10 and 23. Rack gear 10 of element 21 is in mechanical engagement with foot pinion gear 11. Thus, when elongated member 21 is pushed forward (when the arm is lifted as in FIGS. 4 and 5) pinion gear 11 is rotated clockwise thereby rotating axle 19 and foot 4 in a like direction. Note FIGS. 7 and 8. Because of the rack and pinion gear co-action (elements 10 and 11) foot 4 is not only rotated but held steady in the position rendered to it by the action of gears 10 and 11.

Attention is now directed to FIG. 10 and the area around foot control pinion gear 24 located on the opposite side of the righthand most member of arcuate rack gears 6 of FIG. 6. Rack gear 23 of elongated member 21 is in mechanical engagement with a foot control pinion gear 24. Note FIGS. 7 and 8. Foot control pinion gear 24 is fixed (not rotatable) and is disposed between arm 16 and support 25. Note FIG. 10. Axle 26 is affixed to righthand member arcuate rack gear 6 and foot control pinion gear 24. When arm moving pinion gears 12 are rotated, elongated member 21 is pushed forward (compare FIGS. 7 and 8) because of the co-action between foot control pinion gear 24 and rack gear 23, with the resulting rotation of foot control pinion gear 11 and thus foot 4 as previously explained. When the reverse occurs (note the sequence of FIGS. 9, 8, and 7), elongated member 21 is withdrawn (traversed towards arcuate rack gears 6), thus rotating foot pinion gear 11, axle 19 and foot 4 counterclockwise in a manner to keep foot 4 stable and in a horizontal position, no matter the position of arm 16 and 5. Compare FIGS. 3, 4, and 5 as well as FIGS. 7, 8, and 9.

Figure 14:
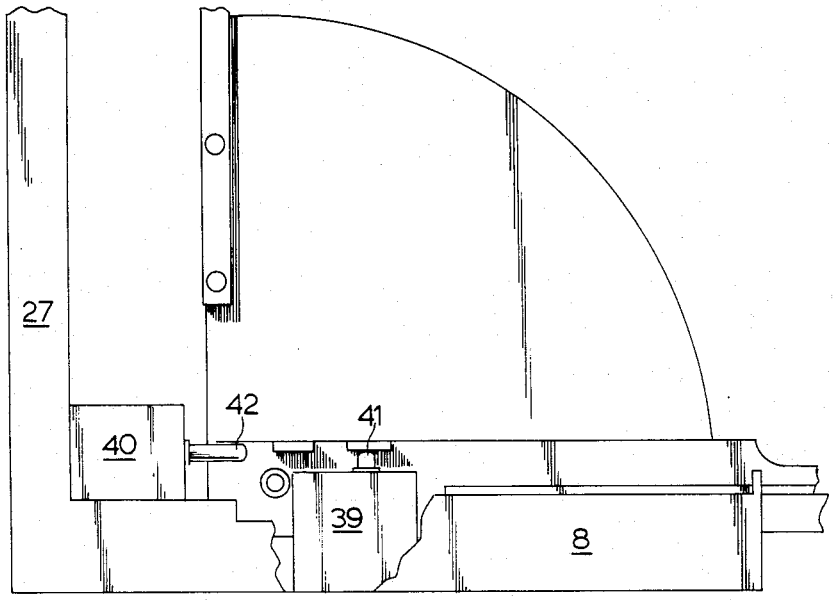
FIGS. 14 and 15 are partial side elevation views of limit switches and arm 16 of the invention.
Figure 15:
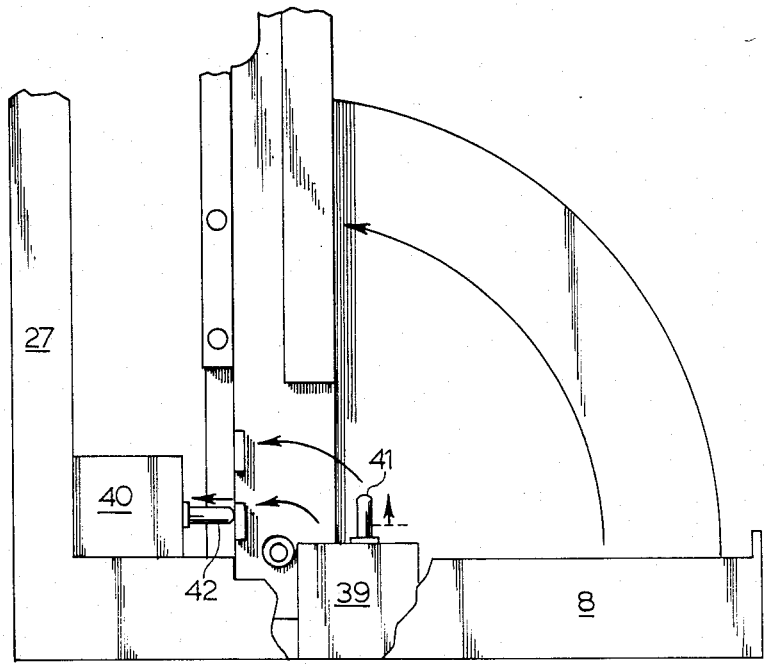

Drive chain 15 is threaded over sprocket 9, which is attached to axle 17 on which the arm moving pinion gears 12 are also attached. Drive chain 15 is threaded over sprocket 31 which is attached to axle 32. Sprocket 34 is fixed to axle 32 and sprocket 36 is fixed to axle 35. Chain 37 is threaded over sprockets 37 and 36. Axle 35 is connected to reduction gear box 38 which is connected to and drives axle 35. Reduction gear box 38 is driven by motor 39, which is activated by a conventional on-off switch (not shown). The extent of the travel of arm 16, either up or down, is controlled by limit switches 39 and 40, see FIGS. 14 and 15. Arm 16 depresses plunger 47 of limit switch 31 when arm 16 reaches its full horizontal position (FIG. 14) and arm 16 depresses ringer 42 of limit switch 40 when arm 16 reaches its full vertical position (FIG. 15), depressing of such plungers deactivates motor 39 thus bringing arm 16 to a halt. Rotation of axle 35 rotates sprocket 36 and chain 37, which rotates sprocket 34 and axle 32. Axle 32 rotates sprocket 31 which rotates chain 15 and sprocket 9. Sprocket 9 rotates axle 17 and pinion gears 12. Depending on the direction of rotation of pinion gears 12, they are either driven upward or downward along the curved portion of arcuate rack gears 6 because of the mechanical engagement of pinion gears 12 with teeth 13. A clockwise rotation of pinion gear 12 raises axle 17 and arm 16 and a counterclockwise rotation lowers the same element.

In the drawings and specification, there have been set forth preferred embodiments of this invention and although specific terms are employed they are used in a generic and descriptive sense only and not for purposes of limitation.

In all cases it is to be understood that the above-described embodiment is illustrative of one of many possible specific embodiments which may represent the principles of our invention. Numerous and various other embodiments can be devised readily in accordance with these principles by those skilled in the art without departing from the spirit and scope of our invention.

What is claimed is:

1. A device for lifting and positioning heavy objects comprising:

(a) a frame;

(b) an arm moving rack gear disposed on the frame;

(c) an arm having first and second terminal portions the first terminal portion rotatively affixed to the arm moving rack gear or the frame;

(d) an arm moving pinion gear rotatively affixed to the arm's first terminal portion in mechanical engagement with the arm moving rack gear adapted to move the arm from a lateral to an upstanding position and from the upstanding to the lateral position upon rotation of the arm moving pinion gear in a predetermined direction;

(e) a foot device rotatively affixed to the arm's second terminal portion;

(f) a foot pinion gear rotatively affixed to the second terminal portion of the arm and fixedly attached to the foot adapted to rotate the foot when the second pinion gear is rotated;

(g) a foot control pinion gear non-rotatively attached to the frame; and, (h) an elongated member having first and second terminal portions, both of which include a rack gear, the rack gear of the first terminal portion of the elongated member being mechanically engaged with the foot control pinion gear and the rack gear of the second terminal portion of the elongated member being mechanically engaged with the foot pinion gear so that when the arm moving pinion gear rotates and moves the arm, the rack gear on the first terminal portion of the elongated member pushes the elongated member towards the foot, thereby causing the rack gear on the second terminal portion of the elongated member to rotate the foot pinion gear and the foot and to maintain the foot essentially stable and horizontal regardless of the position of the arm.

2. The device of claim 1 further including a slot in the arm and at least a portion of the elongated member slidably received in the slot.

3. The device of claim 1 further including a first axle rotatively attached to the arm upon which a pair of spaced apart arm moving pinion gears are fixedly attached.

4. The device of claim 3 wherein the arm is composed of a pair of spaced apart members and the first axle is disposed between and rotatively fixed to the spaced apart members.

5. The device of claim 4 further including a second axle disposed between and rotatively affixed to the pair of spaced apart arms and to which the foot pinion gear is affixed.

6. The device of claim 1 further including a motor and a drive device, the drive device affixed to and adapted to rotate the first axle and the motor affixed to the drive device and adapted to rotate same.

7. The device of claim 1 wherein the frame is composed of an upstanding and a lateral portion.

8. The device of claim 1 wherein the arm moving rack gear is arcuate in shape.

9. The device of claim 8 wherein the arm moving rack gear is disposed between the frame's upstanding and lateral portions.

10. The device of claim 1 wherein the arm moving rack gear is a pair of spaced apart arcuate shaped rack gears, the arm moving pinion gear is a pair of pinion gears each member of the pair in mechanical engagement with one member of the pair of arm moving rack gears, and the arm is a pair of spaced apart members at least one of which contains a slot therein in which at least a portion of the elongated member is slideably received.

11. The device of claim 1 wherein the foot device contains a cross member in which there is a cavity and at least one extension member, a portion of which is "T? shaped, the upstanding portion of the "T? shaped extension member slideably received in the cavity of the cross member.

* * * * *

UNITED STATES PATENT OFFICE

CERTIFICATE OF CORRECTION

Patent No. 4,792,121 Dated December 20, 1988

Inventor(s) Dulin L. Annas, Sr. and Richard M. Teague

It is certified that error appears in the above-identified patent and that said Letters Patent is hereby corrected as shown below:

In Column 2, Line 7, replace the "?" with a quotations mark -- " -- .

In Column 2, Line 41, replace the word "wokkman" with the word -- workman -- .

In Column 3, Line 12, replace the "?" with a quotations mark -- " -- .

In Column 6, Lines 17 and 18, replace the "?" with a quotations mark -- " -- .

Signed and Sealed this

Twenty-seventh Day of June, 1989

*Attest:*

DONALD J. QUIGG

*Attesting Officer*

*Commissioner of Patents and Trademarks*